US011552408B2

(12) United States Patent
Tang et al.

(10) Patent No.: US 11,552,408 B2
(45) Date of Patent: Jan. 10, 2023

(54) BASE STATION ANTENNAS HAVING RF REFLECTORS THEREIN WITH INTEGRATED BACKSIDE MULTI-CHOKE ASSEMBLIES

(71) Applicant: CommScope Technologies LLC, Hickory, NC (US)

(72) Inventors: Chengcheng Tang, Murphy, TX (US); Xiangyang Ai, Plano, TX (US); Gangyi Deng, Allen, TX (US); Amit Kaistha, Coppell, TX (US); Vijay Srinivasan, Salcette (IN); Yateen Sutar, Vasco da Gama (IN)

(73) Assignee: CommScope Technologies LLC, Hickory, NC (US)

( * ) Notice: Subject to any disclaimer, the term of this patent is extended or adjusted under 35 U.S.C. 154(b) by 113 days.

(21) Appl. No.: 17/286,953

(22) PCT Filed: Oct. 11, 2019

(86) PCT No.: PCT/US2019/055839
§ 371 (c)(1),
(2) Date: Apr. 20, 2021

(87) PCT Pub. No.: WO2020/086303
PCT Pub. Date: Apr. 30, 2020

(65) Prior Publication Data

US 2021/0384641 A1 Dec. 9, 2021

Related U.S. Application Data

(60) Provisional application No. 62/892,900, filed on Aug. 28, 2019, provisional application No. 62/749,310, filed on Oct. 23, 2018.

(51) Int. Cl.
*H01Q 1/24* (2006.01)
*H01Q 19/02* (2006.01)
*H01Q 5/48* (2015.01)

(52) U.S. Cl.
CPC ..... *H01Q 19/022* (2013.01); *H01Q 1/246* (2013.01); *H01Q 5/48* (2015.01)

(58) Field of Classification Search
CPC ..... H01Q 19/022; H01Q 1/246
See application file for complete search history.

(56) References Cited

U.S. PATENT DOCUMENTS 8,928,548 B2 1/2015 Harel et al.
10,601,120 B2 3/2020 Bisiules et al.
(Continued)

FOREIGN PATENT DOCUMENTS

CN 105048066 B 3/2018
KR 20100015387 A 2/2010
(Continued)

OTHER PUBLICATIONS

Notification of Transmittal of the International Search Report and the Written Opinion of the International Searching Authority, or the Declaration, in corresponding PCT Application No. PCT/US2019/055839 (dated Feb. 19, 2020).
(Continued)

*Primary Examiner* — Daniel Munoz
(74) *Attorney, Agent, or Firm* — Myers Bigel, P.A.

(57) ABSTRACT

A base station antenna (BSA) includes a reflector having a main reflector surface thereon, which extends between first and second sidewalls thereof. First and second choke-within-a-choke assemblies are provided on first and second sides of the reflector, respectively. The first choke-within-a-choke assembly includes: a first relatively low-band choke defined on one side thereof by the first sidewall of the
(Continued)

reflector, and a first relatively high-band choke contacting on two sides thereof a rear surface of the reflector and an inner surface of the first sidewall. The second choke-within-a-choke assembly includes: a second relatively low-band choke defined on one side thereof by the second sidewall of the reflector, and a second relatively high-band choke contacting on two sides thereof the rear surface of the reflector and an inner surface of the second sidewall.

22 Claims, 13 Drawing Sheets

(56) References Cited

U.S. PATENT DOCUMENTS

| | | | | |
|---|---|---|---|---|
| 2005/0110699 | A1 | 5/2005 | Timofeev et al. | |
| 2006/0238427 | A1 | 10/2006 | Ferguson et al. | |
| 2009/0021437 | A1 | 1/2009 | Foo | |
| 2010/0117916 | A1 | 5/2010 | Gustafsson et al. | |
| 2012/0280881 | A1 | 11/2012 | Beausang | |
| 2016/0172765 | A1* | 6/2016 | Motta-Cruz | H01Q 1/1271 343/834 |
| 2018/0083368 | A1 | 3/2018 | Teillet et al. | |

FOREIGN PATENT DOCUMENTS

| | | | |
|---|---|---|---|
| KR | 20110120117 | A | 11/2011 |
| WO | 2010018898 | A1 | 2/2010 |
| WO | 2018212825 | A1 | 11/2018 |

OTHER PUBLICATIONS

Picture of Reflector and RF Chokes for Prior Art Antenna 1. (Admitted Prior Art) (1 page).

Pictures of Reflector and RF Choke for Prior Art Antenna 2. (Admitted Prior Art) (1 page).

Pictures of Reflector and RF Chokes for Prior Art Antenna 3. (Admitted Prior Art) (1 page).

* cited by examiner

BASE STATION ANTENNAS HAVING RF REFLECTORS THEREIN WITH INTEGRATED BACKSIDE MULTI-CHOKE ASSEMBLIES

CLAIM OF PRIORITY

This application is a 35 U.S.C. § 371 national stage application of PCT Application No. PCT/US2019/055839, filed on Oct. 11, 2019, which itself claims priority to U.S. Provisional Application Ser. No. 62/892,900, filed Aug. 28, 2019, and 62/749,310, filed Oct. 23, 2018, the disclosures of which are hereby incorporated herein by reference. The above-referenced PCT Application was published in the English language as International Publication No. WO 2020/086303 A1 on Apr. 30, 2020.

CROSS-REFERENCE TO RELATED APPLICATION

This application is related to International Patent Application No. PCT/US18/22572, filed Mar. 15, 2018, entitled "Base Station Antenna Having Reflector Assemblies with RF Chokes," which claims priority to U.S. Provisional Application Ser. No. 62/507,346, filed May 17, 2017, the disclosures of which are hereby incorporated herein by reference.

FIELD OF THE INVENTION

The present invention relates to wireless communications and, more particularly, to base station antennas for cellular communication systems.

BACKGROUND

Cellular communications systems are well known in the art. In a cellular communications system, a geographic area is typically divided into a series of regions that are referred to as "cells," and each cell is served by a so-called "macrocell" base station. The macrocell base station supports two-way radio frequency ("RF") communications with mobile subscribers that are geographically positioned within the cell served by the base station. In many cases, each macrocell base station is divided into multiple "sectors," and different base station antennas, radios and other equipment are used to provide cellular service in each sector. For example, in a common configuration, a base station may be divided into three sectors, and each base station antenna is designed to provide coverage for about 120° in the azimuth plane. The base station antennas may be mounted on a tower or other raised structure, and the radiation beams generated by each antenna are typically directed outwardly to serve each respective sector.

Most macrocell base station antennas include one or more linear arrays of radiating elements that are mounted on a front surface of a typically mostly flat reflector, which acts as an underlying ground plane for the radiating elements and advantageously redirects RF energy that is emitted rearwardly by the radiating elements back to a forward direction. As shown by FIG. 1A, which is a cross-sectional view of a conventional metal reflector 10 configured to support multiple columns of radiating elements (not shown) on a main reflective surface 20 thereof, a pair of RF chokes 12*a*, 12*b* may be integrated within respective left and right sides of the metal reflector 10. In particular, the reflector 10, which has a front 14*a* and a back 14*b*, may be constructed from a sheet of metal, such as aluminum, so that the front 14*a* of the reflector 10 acts as the main reflective surface 20 for redirecting RF energy to the forward direction, but the left and right sides operate as RF chokes 12*a*, 12*b*. These chokes 12*a*, 12*b* are defined by generally U-shaped channels 16*a*, 16*b* that preferably run the length of the reflector 10.

As will be understood by those skilled in the art, an RF choke is a passive circuit element that allows some currents to pass, but which is designed to block or "choke" other currents in certain frequency bands. And, as shown by FIG. 1B, which is an enlarged cross-sectional view of the left RF choke 12*a* of FIG. 1A, the left U-shaped channel 16*a* of the reflector 10 may have an electrical path length L1 that is equivalent to 2×D1+W1, which is the sum of the heights of each side (D1) and the width (W1) of the bottom of the U-shape channel 16*a*. This path length L1 typically corresponds to a 180° phase shift at the center frequency of the frequency band at which one of the linear arrays of radiating elements of the antenna radiates RF energy. Consequently, RF currents that are carried outwardly on the main reflective surface 20 may pass down the inner side of each RF choke 12*a*, 12*b*, along the bottom thereof and then back up the outermost side of each RF choke 12*a*, 12*b*. As the RF signals at the top of the outer side of the U-shaped channels 16*a*, 16*b* of the RF chokes 12*a*, 12*b* are about 180° out-of-phase with the RF signals at the top of the inner side of U-shaped channels 16*a*, 16*b*, these phase-shifted signals tend to cancel each other so that interfering radiation from opposing sides of the reflector 10 can be advantageously suppressed.

SUMMARY OF THE INVENTION

Base station antennas (BSAs) according to some embodiments of the invention can include a reflector having a first plurality of radiating elements on a main reflector surface thereof. These radiating elements may include a collection of relatively low-band radiating elements, relatively high-band radiating elements and/or mid-band radiating elements, which may extend closely to the edges of the reflector in order to make full use of the antenna width for multi-column, multi-band applications. The reflector also includes a first rearwardly projecting sidewall on a first side thereof, and a first choke-within-a-choke (CWC) assembly. This first CWC assembly includes at least a portion of the first rearwardly projecting sidewall and wraps behind the main reflector surface so that a first choke opening is provided between a rear surface of the reflector and an end of a first choke within the first CWC assembly. This reflector may also include a second rearwardly projecting sidewall on a second side thereof, and a second choke-within-a-choke (CWC) assembly. This second CWC assembly includes at least a portion of the second rearwardly projecting sidewall and wraps behind the main reflector surface so that a second choke opening is provided between the rear surface of the reflector and an end of a first choke within the second CWC assembly. Advantageously, these opposing first and second CWC assemblies may collectively operate to improve azimuth beam width, azimuth pattern roll-off, front-to-back ratio (F/B) and/or cross polarization ratio (CPR), notwithstanding the close spacing between one or more the radiating elements and the edges of the reflector.

According to some embodiments of the invention, a width of the reflector is equivalent to a width of the main reflector surface, as measured between the first and second rearwardly projecting sidewalls. In addition, the first and second choke-within-a-choke assemblies may extend entirely within a space between the first and second rearwardly projecting sidewalls, on a rear surface of the reflector, so that the chokes do not contribute to an enlargement in the overall width of the reflector.

According to additional embodiments of the invention, the first choke-within-a-choke assembly includes a first relatively high-band choke within a first relatively low-band choke. This first relatively low-band choke may be configured as an at least three-sided choke, and the first relatively high-band choke may be configured as an at least four-sided choke. In addition, the first relatively high-band choke may be configured to contact an inner surface of the first rearwardly projecting sidewall, and contact the rear surface of the reflector. Moreover, in the event the first relatively high-band choke is configured as a five-sided choke, then four of the five sides of the first relatively high-band choke may be configured to lie along respective sides of a rectangle when viewed in transverse cross-section. In addition, the five-sided high-band choke may include three sides extending parallel to the first rearwardly projecting sidewall and two sides extending parallel to the main reflector surface.

According to further embodiments of the invention, the first relatively high-band choke may be configured so that its width is in a range from about 0.4 times to about 0.7 times a width of the first relatively low-band choke, when they are viewed in transverse cross-section. The first rearwardly projecting sidewall may also be configured to have at least a first slot therein, which exposes an opening in the first relatively high-band choke.

According to additional embodiments of the invention, a base station antenna reflector can include a main reflector surface extending between first and second rearwardly projecting reflector sidewalls on respective first and second sides of the reflector. A relatively low-band choke is also provided, which includes at least a portion of the first rearwardly projecting reflector sidewall. A first relatively high-band choke is provided, which extends adjacent a rear surface of the reflector and adjacent an inner surface of the first rearwardly projecting reflector sidewall. This first relatively high-band choke abuts at least one of the rear surface of the reflector and the inner surface of the first rearwardly projecting reflector sidewall. The first rearwardly projecting sidewall (and/or the main reflector surface) may also have a slot therein that exposes an opening in the first relatively high-band choke. According to additional embodiments of the invention, a second relatively high-band choke may be provided, which extends adjacent the rear surface of the reflector and adjacent an inner surface of the first rearwardly projecting reflector sidewall. In some of these embodiments, one or more of the first and second relatively high-band chokes can have different transverse cross-sections relative to the others to thereby support different relatively high-band choking frequencies. Likewise, in further embodiments of the invention, the relatively low-band chokes associated with the first and second rearwardly projecting reflector sidewalls may have different transverse cross-sections to thereby support different relatively low-band choking frequencies. Similarly, in further embodiments of the invention, the plurality of relatively high-band chokes distributed along each side of the reflector can have different cross-sectional and other dimensions, including different electrical lengths, to thereby support different relatively high-band choking frequencies.

According to still further embodiments of the invention, a base station antenna reflector is provided, which includes a main reflector surface extending between first and second rearwardly projecting reflector sidewalls on respective first and second sides of the reflector. An at least three-sided choke is provided, which includes at least a portion of the first rearwardly projecting reflector sidewall, and has an opening therein extending between an end of the at least three-sided choke and a rear surface of the reflector. In addition, an at least four-sided choke is provided, which extends on the rear surface of the reflector and on an inner surface of the first rearwardly projecting reflector sidewall. This at least four-sided choke may be one of a plurality of at least four-sided chokes, which are distributed along a length of the first rearwardly projecting reflector sidewall. In some embodiments of the invention, at least two of the plurality of at least four-sided chokes have different dimensions when viewed in transverse cross-section, to thereby support different choking frequencies.

A base station antenna reflector according to an additional embodiments of the invention includes a main reflector surface extending between first and second rearwardly projecting reflector sidewalls on respective first and second sides of the reflector. A first three or more sided choke is provided, which includes at least a portion of the first rearwardly projecting reflector sidewall and has a choke opening therein defined on one side thereof by a rear surface of the reflector. A second three of more sided choke is provided, which includes at least a portion of the second rearwardly projecting reflector sidewall and has a choke opening therein defined on one side thereof by the rear surface of the reflector. A first four or more sided choke is also provided, which extends on the rear surface of the reflector and on an inner surface of the first rearwardly projecting reflector sidewall. A second four or more sided choke is provided, which extends on the rear surface of the reflector and on an inner surface of the second rearwardly projecting reflector sidewall. The first rearwardly projecting reflector sidewall may have a first slot therein, which exposes a corresponding choke opening in the first four or more sided choke. The second rearwardly projecting reflector sidewall may have a second slot therein, which exposes a corresponding choke opening in the second four or more sided choke. The choke opening in the first three or more sided choke and the choke opening in the second three of more sided choke may be provided as diametrically opposite openings that face each other adjacent the rear surface of the reflector.

In an additional embodiment of the invention, a base station antenna is provided, which includes a reflector having a main reflector surface thereon that extends between first and second sidewalls thereof. A first choke-within-a-choke assembly is provided on a first side of the reflector. This first choke-within-a-choke assembly includes a first relatively low-band choke defined on one side thereof by the first sidewall of the reflector, and a first relatively high-band choke, which contacts, on two sides thereof, a rear surface of the reflector and an inner surface of the first sidewall. In addition, a second choke-within-a-choke assembly is provided on a second side of the reflector. This second choke-within-a-choke assembly includes a second relatively low-band choke defined on one side thereof by the second sidewall of the reflector, and a second relatively high-band choke, which contacts, on two sides thereof, the rear surface of the reflector and an inner surface of the second sidewall. According to some embodiments, the first relatively low-band choke is a three-sided choke, and the first relatively high-band choke is a five-sided choke. The reflector may also have a first opening therein, which exposes an opening in the first relatively high-band choke. This first opening may be located at an intersection (i.e., a "corner") between the main reflector surface and the first sidewall of the reflector. Alternatively, the first opening may extend within the first sidewall of the reflector, at a location spaced from an intersection between the main reflector surface and the first sidewall of the reflector.

According to additional aspects of these embodiments of the invention, the first choke-within-a-choke assembly may include N spaced-apart and relatively high-band chokes extending along a length of the first sidewall of the reflector, and the reflector may have N openings therein, which are collinear and expose respective openings in the N relatively high-band chokes, where N is a positive integer greater than one. In addition, a plurality of relatively low-band radiating elements may be provided on the main reflector surface. 2N spaced-apart and relatively high-band radiating elements may also be provided on the main reflector surface, and extend between the plurality of relatively low-band radiating elements and the first sidewall of the reflector. According to some of these embodiments of the invention, the N openings can be configured as N elongate slots. Advantageously, a length of each of the N elongate slots may be in a range from about 1.4 times to about 1.5 times a spacing between said 2N spaced-apart and relatively high-band radiating elements.

In still further embodiments of the invention, a base station antenna is provided, which includes a reflector having a main reflector surface thereon that extends between first and second sidewalls thereof. A tri-choke assembly is provided as a choke-within-a-choke-within-a-choke assembly. This assembly includes: (i) a relatively low-band choke defined on one side thereof by the first sidewall of the reflector, (ii) a relatively mid-band choke on the first sidewall of the reflector, and (iii) a relatively high-band choke within at least a portion of the first relatively mid-band choke. In some of these embodiments of the invention, the relatively mid-band choke has a choke opening therein, which is aligned to a choke opening in the first sidewall of the reflector. In addition, the relatively high-band choke may have a choke opening therein aligned to the choke opening in the relatively mid-band choke.

In further embodiments of the invention, a base station antenna is provided, which includes a main reflector surface that extends between first and second sidewalls thereof. A tri-choke assembly is also provided, which includes: (i) a relatively low-band choke defined on one side thereof by the first sidewall of the reflector, (ii) a relatively mid-band choke, which extends adjacent the first sidewall of the reflector, and (iii) a relatively high-band choke, which extends adjacent the first sidewall of the reflector. In some of these embodiments of the invention, the reflector may include first and second choke openings therein, which are aligned to an opening in the relatively mid-band choke and an opening in the relatively high-band choke, respectively.

According to an additional embodiment of the invention, a base station antenna is provided, which includes a reflector having a non-planar main reflector surface thereon. This non-planar surface is defined by a raised and rigidity-enhancing rib extending at least a majority of the length of the reflector. The reflector also includes: (i) a first rearwardly projecting sidewall on a first side thereof, and (ii) a first choke that includes at least a portion of the first rearwardly projecting sidewall and wraps behind the main reflector surface so that a first choke opening is provided between a rear surface of the reflector and a portion of the first choke. The reflector may also include a second rearwardly projecting sidewall on a second side thereof, and a second choke that includes at least a portion of the second rearwardly projecting sidewall and wraps behind the main reflector surface so that a second choke opening is provided between the rear surface of the reflector and a portion of the second choke. A width of the reflector can be equivalent to a width of the main reflector surface, as measured between the first and second rearwardly projecting sidewalls, and the first and second chokes can extend entirely within a space between the first and second rearwardly projecting sidewalls. In some of these embodiments of the invention, a width of the rigidity-enhancing rib is in a range from 0.2 to 0.3 times the width of the reflector. The rigidity-enhancing rib may extend the full length of the reflector and may support the use of thinner reflectors.

BRIEF DESCRIPTION OF THE DRAWINGS

FIG. 10 is a cross-sectional view of an RF choke and a choke cover, which may be utilized to improve performance of the reflector of FIG. 1A.

DETAILED DESCRIPTION OF EMBODIMENTS

Figure 1A:
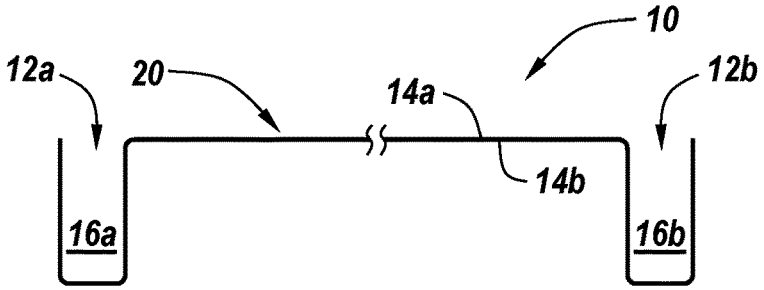
FIG. 1A (Prior Art)
FIG. 1A is a cross-sectional view of a conventional reflector with RF chokes, which is configured for use in a base station antenna.
Figure 1B:
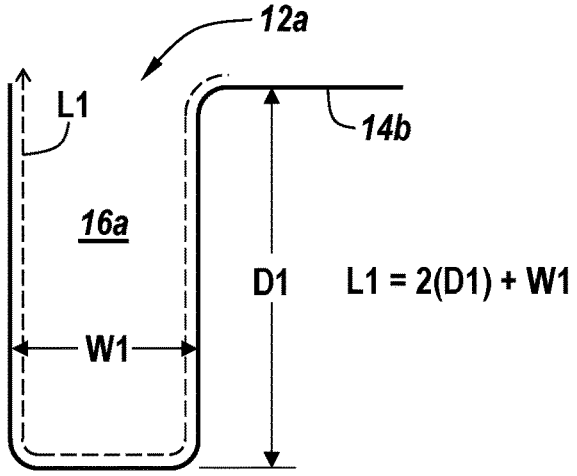
FIG. 1B (Prior Art)
FIG. 1B is an enlarged cross-sectional view of an RF choke implemented within the reflector of FIG. 1A.
Figure 1C:
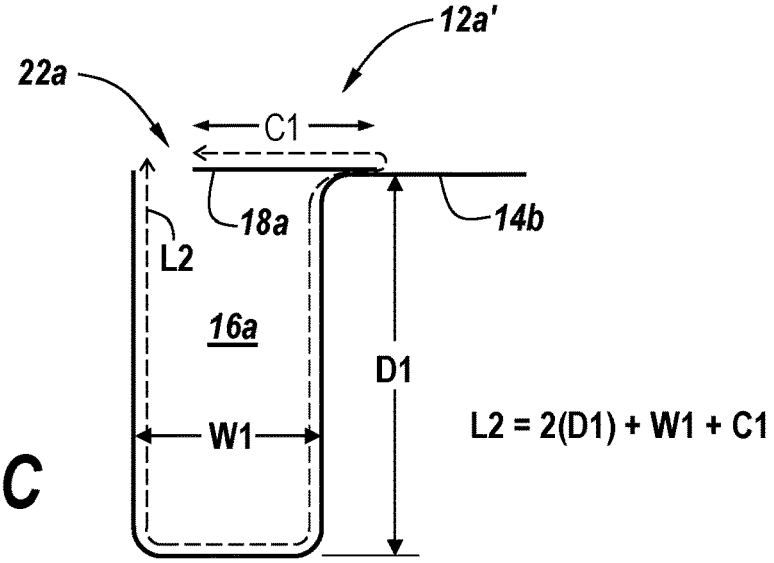
FIG. 1D is a cross-sectional view of an RF choke with a choke cover having horizontal and vertical segments, which may be utilized to improve performance of the reflector of FIG. 1A.
FIG. 1E is a cross-sectional view of a reflector with higher band (HB) and lower band (LB) chokes.

Referring now to FIG. 10, the effective path length L1 of the choke 12*a* of FIGS. 1A-1B may be increased by including a choke cover 18*a*, which extends over and partially covers the upwardly facing opening in the U-shaped channel 16*a* and thereby facilitates the design of more compact chokes 12*a*' that can support lower frequency bands (i.e., signals having longer wavelengths). Accordingly, by including a choke cover 18*a*, as shown, the left RF choke 12*a*' of FIG. 10 may have a relatively narrow and front facing choke opening 22*a* and an extended electrical path length L2, which is equivalent to 2×D1+W1+C1.

Figure 1D:
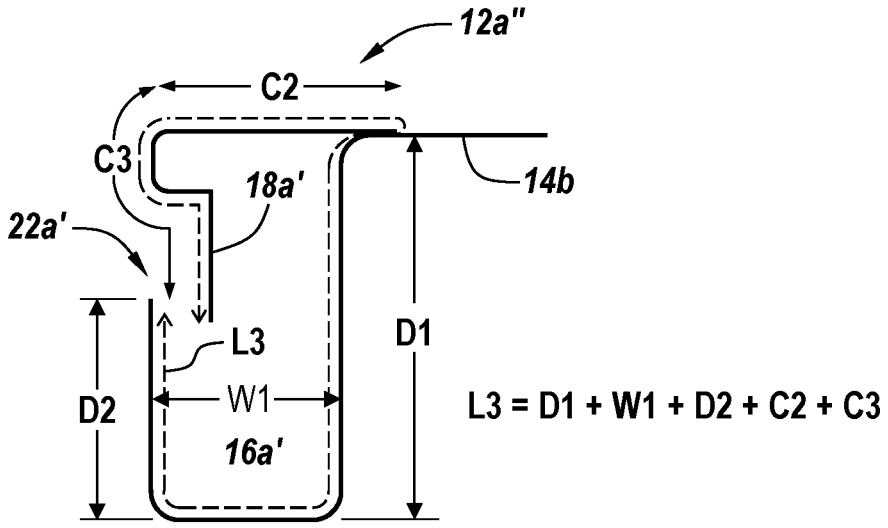

Referring now to FIG. 1D, the effective path length L2 of the choke 12*a*' of FIG. 10 may be further increased by including a modified and nonplanar choke cover 18*a*' attached to a choke 12*a*". This modified choke cover 18*a*', which extends over an asymmetric U-shaped channel 16*a*' having unequal height sides D1 and D2, includes laterally and curved rearwardly extending cover segments C2, C3, as shown. These cover segments C2 and C3 collectively define a modified forwardly-directed choke opening 22*a*' that is spaced rearwardly relative to the back 14*b* of the reflector 10. Based on these segments, the effective path length of the modified choke 12*a*" is equivalent to L3, which is the sum of the length of five (5) segments: D1+D2+W1+C2+C3.

Figure 1E:
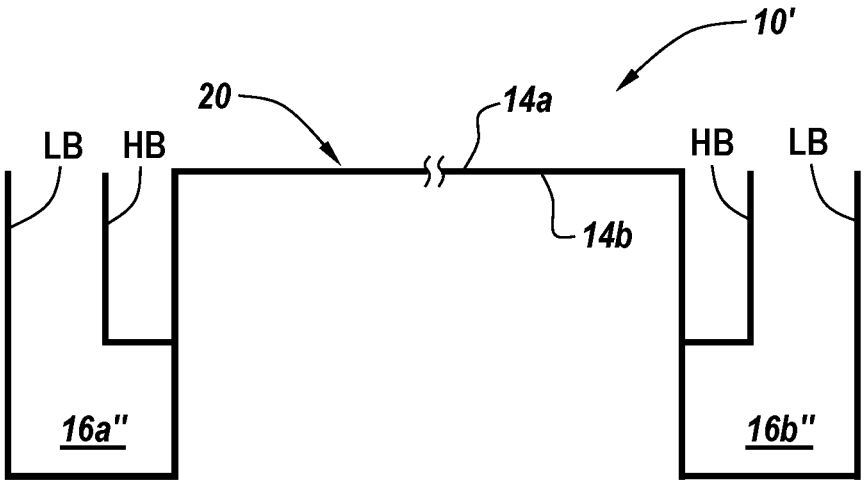

Finally, as shown by FIG. 1E, another conventional antenna reflector 10', which is configured to support multiple columns of relatively higher band and relatively lower band radiating elements (not shown) on a main reflective surface 20 thereof, may utilize modified U-shaped channels 16*a*" that are configured to provide both higher band (HB) chokes and lower band (LB) chokes having different electrical path lengths. As will be understood by those skilled in the art, these HB and LB chokes preferably provide respective 180° phase shifts for RF signals having relatively high and low frequencies associated with the higher band and lower band radiating elements.

Figure 4A:
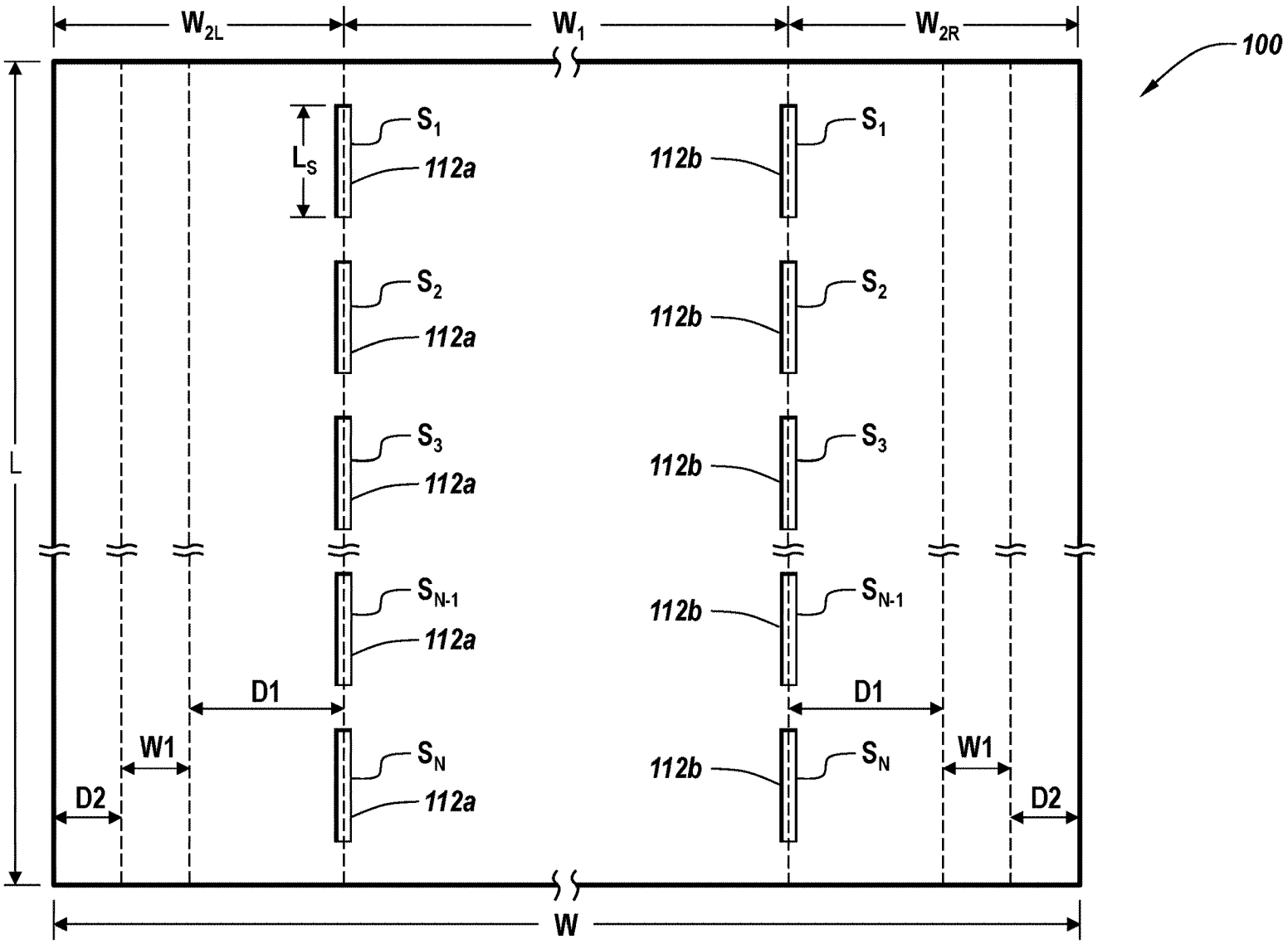
FIG. 4A is a plan view of the reflector of FIG. 2A prior to definition of the left side and right side lower band chokes.
Figure 4B:
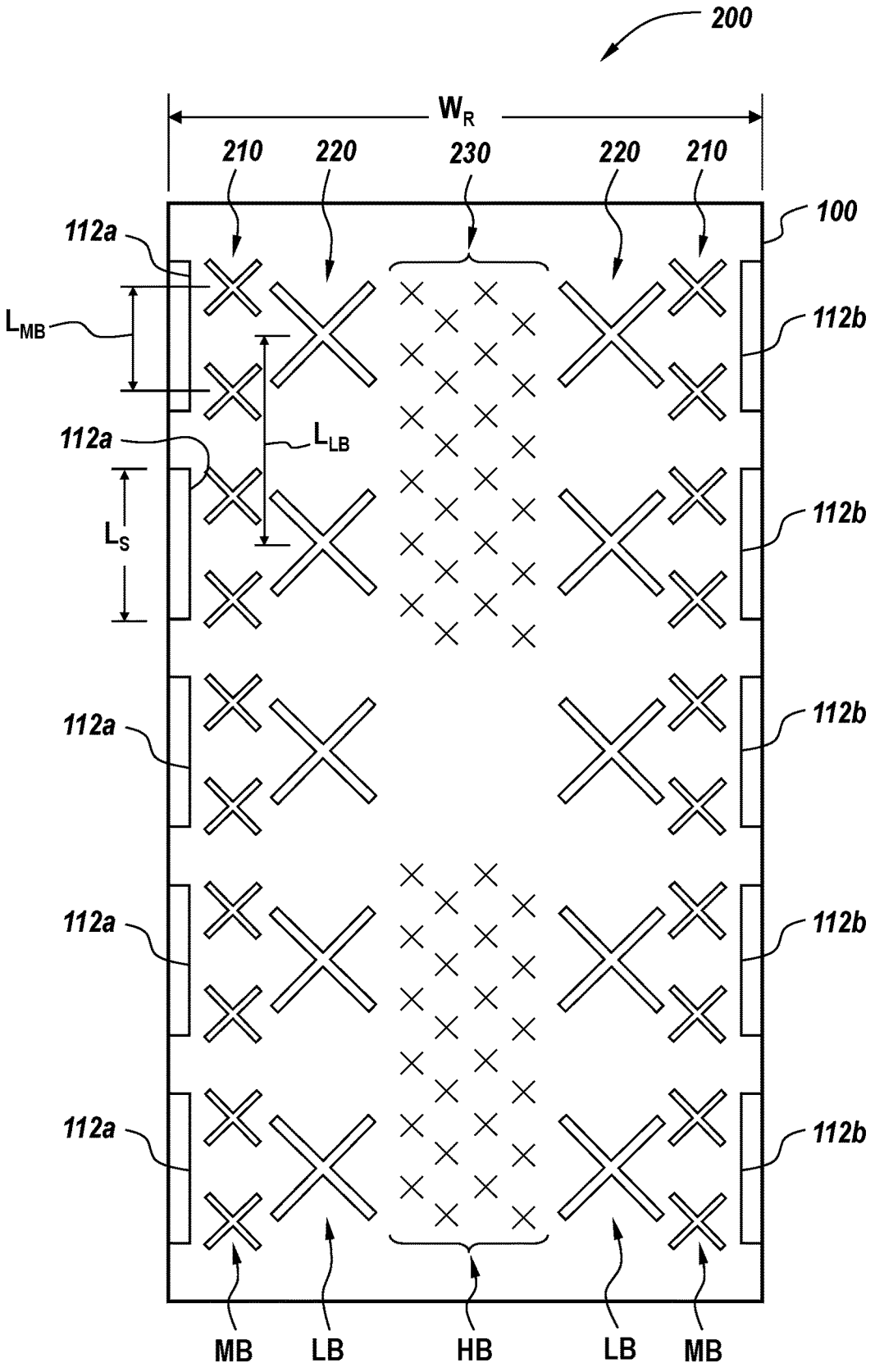
FIG. 4B is a schematic plan view of base station antenna (BSA) containing side-by-side linear arrays of relatively lower band (LB) and higher band (HB) radiating elements mounted on the reflector of FIG. 2A, according to an embodiment of the invention.

Referring now to FIGS. 2A-2C and 4B, a reflector 100 for a base station antenna (BSA) may be provided with RF choke assemblies, which are integrated into a rear side of the reflector 100, and a dense collection of radiating elements on a front side of the reflector 100. As shown in FIG. 4B, this dense collection of radiating elements may include linear arrays of low-band (LB) radiating elements 220, mid-band (MB) radiating elements 210 and possibly high-band (HB) radiating elements 230, arranged in columns as shown, however, other arrangements and relative placement of columns are possible. In some embodiments of a BSA, one or more groups (e.g., columns) of radiating elements 210, 220 and/or 230 can extend closely to the edges of the reflector 100 in order to make full use of the antenna width for multi-column, multi-band applications. Moreover, because one or more LB, MB and HB arrays of radiating elements may suffer from poor radiation patterns in terms of front-to-back ratio (F/B) and cross polarization ratio (CPR) when they are mounted too close to the edges of the reflector 100, the reflector 100 is preferably provided as a multi-choked reflector 100 with rear side choke-within-a-choke (CWC) assemblies, as defined more fully hereinbelow.

Figure 2A:
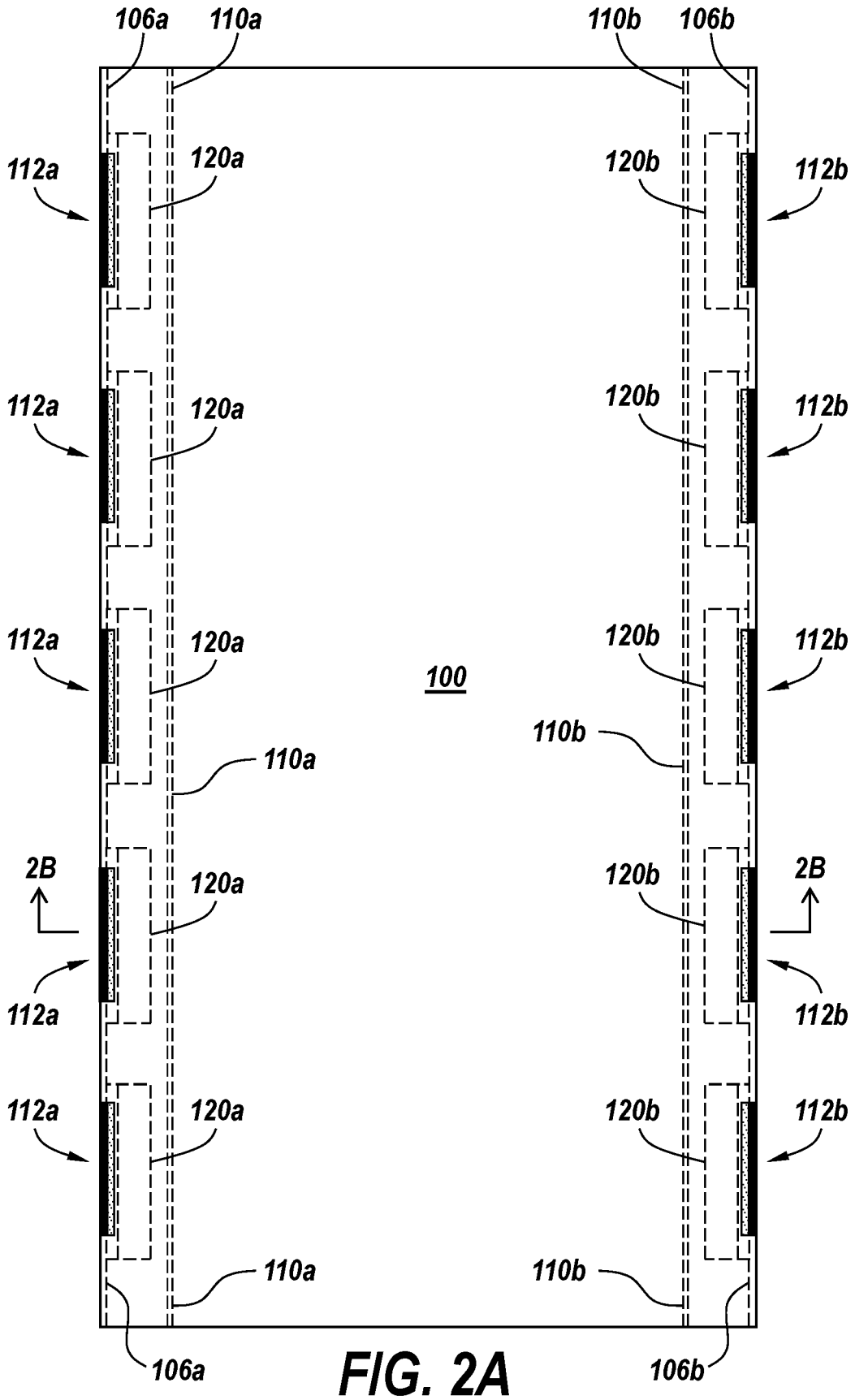
FIG. 2A is a plan view of a base station antenna reflector having backside multi-choke assemblies integrated therein, according to an embodiment of the invention.
Figure 2B:
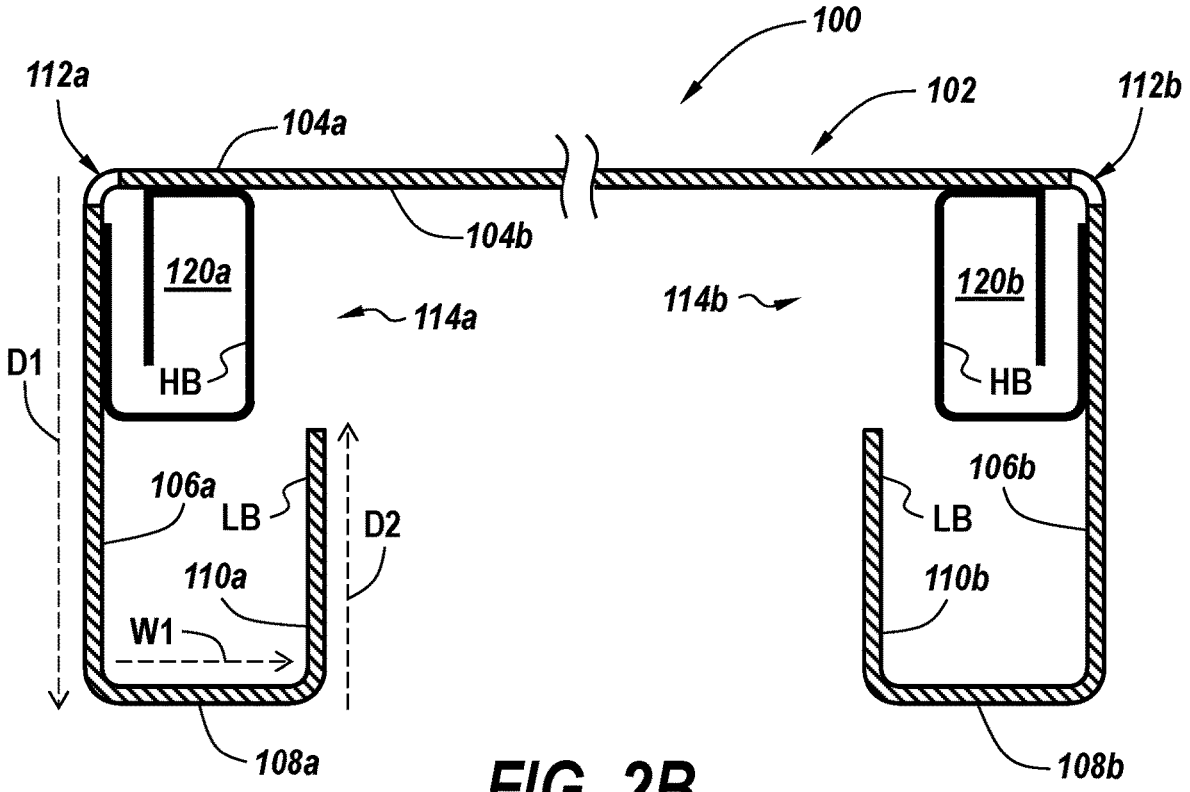
FIG. 2B is a cross-sectional view of the reflector of FIG. 2A, taken along line 2B-2B.
Figure 2C:
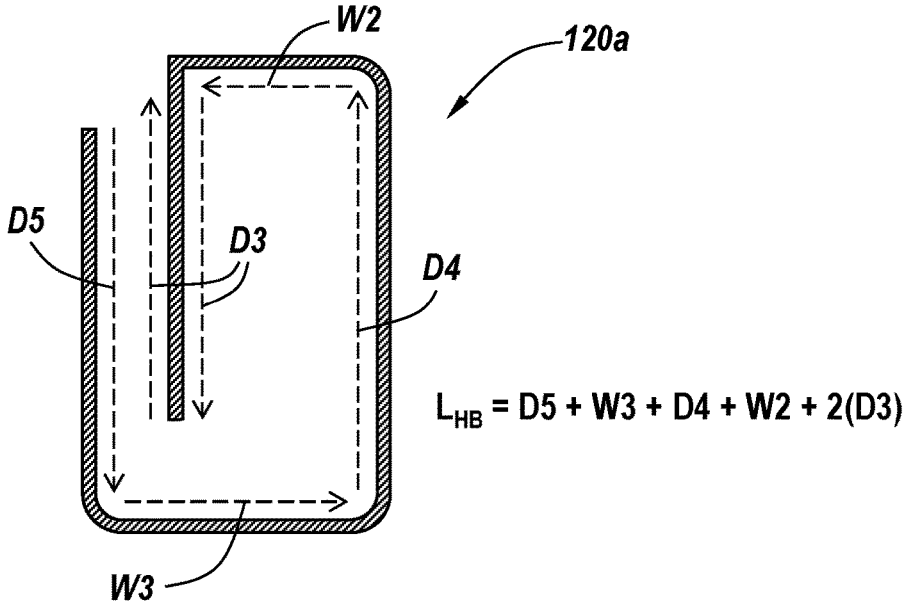
FIG. 2C is an enlarged cross-sectional view of the left side higher band (HB) choke of FIG. 2B.

In particular, the multi-choked reflector 100 is illustrated in FIGS. 2A-2C as including a main reflector surface 102 on a front side 104*a* of the reflector 100, which is defined on opposing left and right sides by rearwardly extending reflector sidewalls 106*a*, 106*b*. As shown best by FIG. 2B, these sidewalls 106*a*, 106*b* define respective sides of a pair of 3-sided and relatively long low-band (LB) chokes. These LB chokes on the left and right sides of the reflector 100 include respective "bottoms" 108*a*, 108*b* and interior sidewalls 110*a*, 110*b*, which extend opposite a rear side 104*b* of the reflector 100. The exposed ends of interior sidewalls 110*a*, 110*b* define opposing choke openings 114*a*, 114*b* that face each other adjacent the rear side 104*b* of the reflector 100. Based on this configuration, the electrical lengths $L_{LB}$ of these LB chokes are equivalent to the sum of the length of the three sides shown in FIG. 2B (i.e., $L_{LB}$=D1+W1+D2). Moreover, because the LB chokes may run the entire length of the reflector 100 as shown by FIG. 2A, they may also contribute significantly to the structural integrity of the antenna, which may be important as the current trends are to include more linear arrays of radiating elements and other components (e.g., diplexers, filters) in order to support advanced communications technologies.

In addition, a plurality of spaced-apart relatively "higher-band" (HB) chokes 120*a*, 120*b* are distributed within the opposing low-band chokes, along the length of the reflector 100, as shown by FIGS. 2A-2B, where the term "higher-band" refers to a higher frequency range relative to the frequency range associated with LB radiating elements 220. Each of these higher-band chokes 120*a*, 120*b* is illustrated as a five-sided choke, with vertical sides D3, D4 and D5 and horizontal sides W2 and W3 that collectively yield respective choke lengths $L_{HB}$=D5+W3+D4+W2+2(D3), which may correspond to λ/2 where λ is the wavelength of the center frequency of the frequency range associated with the MB radiating elements 210. Although not wishing to be bound by any theory, the relatively high-band chokes 120*a*, 102*b* may be configured so that the width dimension W3 is in a range from about 0.4 times to about 0.7 times a width W1 of the low-band chokes along the bottoms 108*a*, 108*b*.

As shown by FIGS. 2B-2C, the ten (10) HB chokes 120*a*, 120*b* are configured so that four of the five sides: D3, D4, W2 and W3 lie along edges of a rectangle when these chokes are viewed in transverse cross-section. Moreover, each pair of vertical sides D3 and D5 define respective choke openings, which are exposed to (and receive RF energy from) corresponding elongate openings/slots 112*a*, 112*b* within the reflector 100, at corners between the main reflector surface 102 and the reflector sidewalls 106*a*, 106*b*. As shown by FIGS. 2A, these through-slots 112*a*, 112*b* in the reflector 100 expose underlying portions of the rearwardly extending reflector sidewalls 106*a*, 106*b* (shown as dark line segments) and underlying portions of the vertical sides D5 of the HB chokes 120*a*, 120*b* (shown by speckled shading).

Figure 2D:
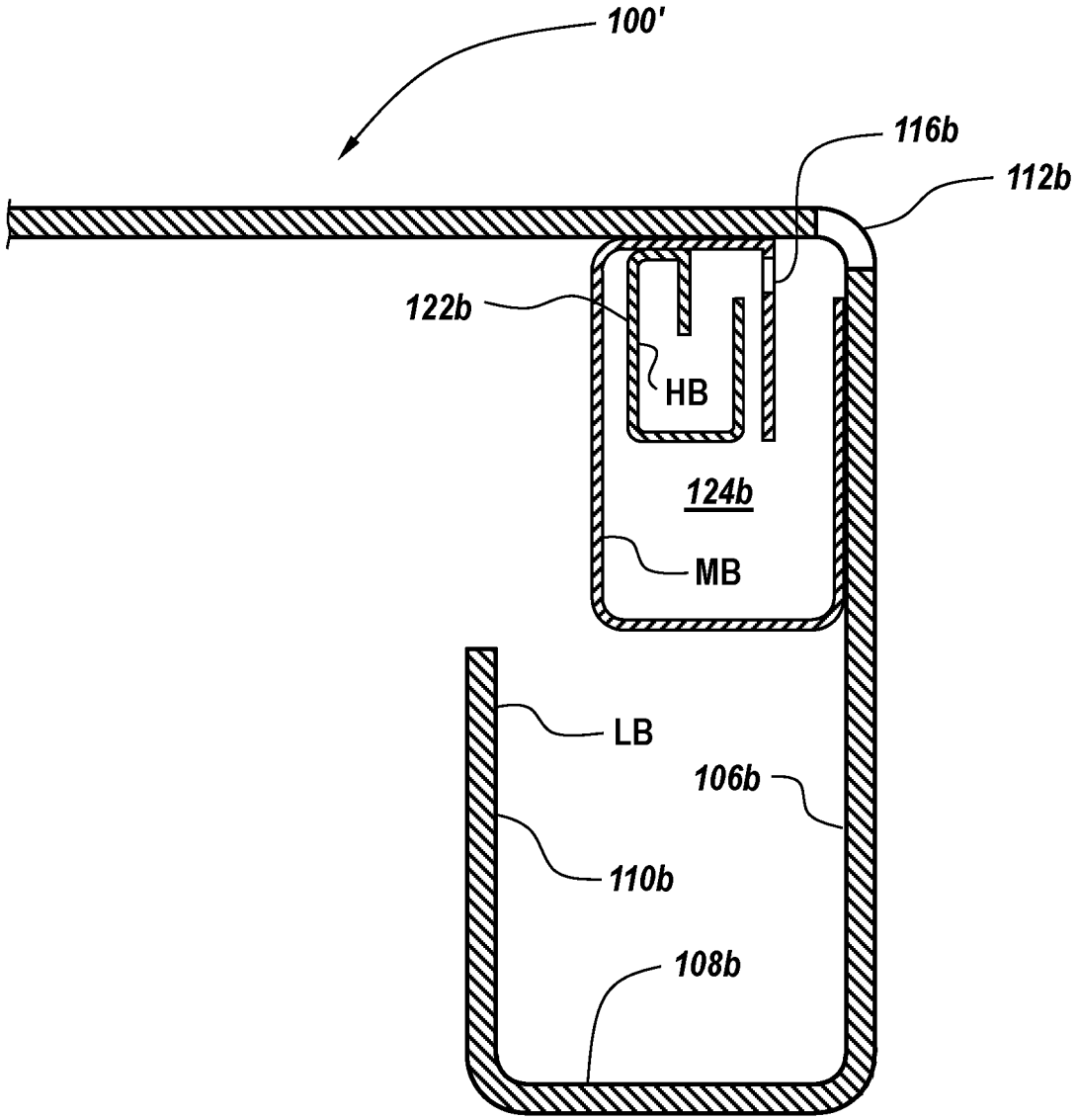
FIG. 2D is a partial cross-sectional view of the reflector of FIG. 2B as modified to include a tri-choke (e.g., choke-within-a-choke-within-a-choke) assembly, according to an embodiment of the invention.

In addition, as illustrated by the partial cross-sectional view of FIG. 2D, according to still further embodiments of the invention, a respective tri-choke assembly may be provided adjacent each of the pair of rearwardly extending reflector sidewalls of a reflector 100'. In particular, as shown, a relatively high band (HB) choke 122*b* may be provided at least partially within a relatively mid-band (MB) choke 124*b*, which may be provided at least partially within a relatively low-band (LB) choke defined by reflector segments 106*b*, 108*b* and 110*b* and choke opening 114*b*. As further shown by FIG. 2D, elongate choke openings/slots 112*b*, 116*b*, which are preferably aligned to each other, are provided to support coupling of RF energy into each of the HB and MB chokes (122*b*, 124*b*). As explained more fully hereinbelow with respect to the tri-band antenna 200 of FIG. 4B, the dimensions of the multi-sided LB, MB and HB chokes may be established to support the respective frequency bands associated with the LB, MB and HB radiating elements (220, 210 and 230).

Figure 3A:
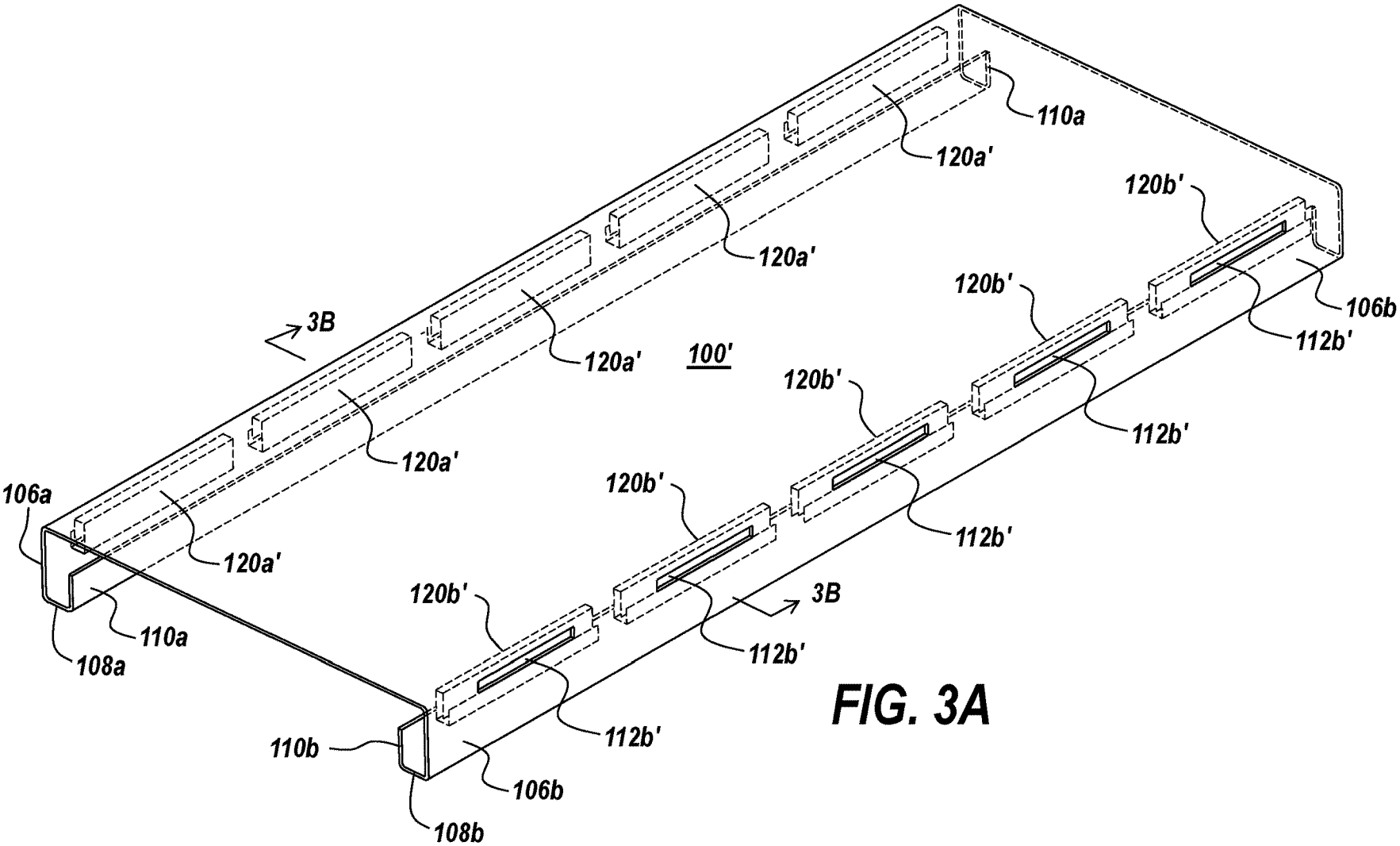
FIG. 3A is a perspective view of a base station antenna reflector having backside multi-choke assemblies integrated therein, according to an embodiment of the invention.
Figure 3B:
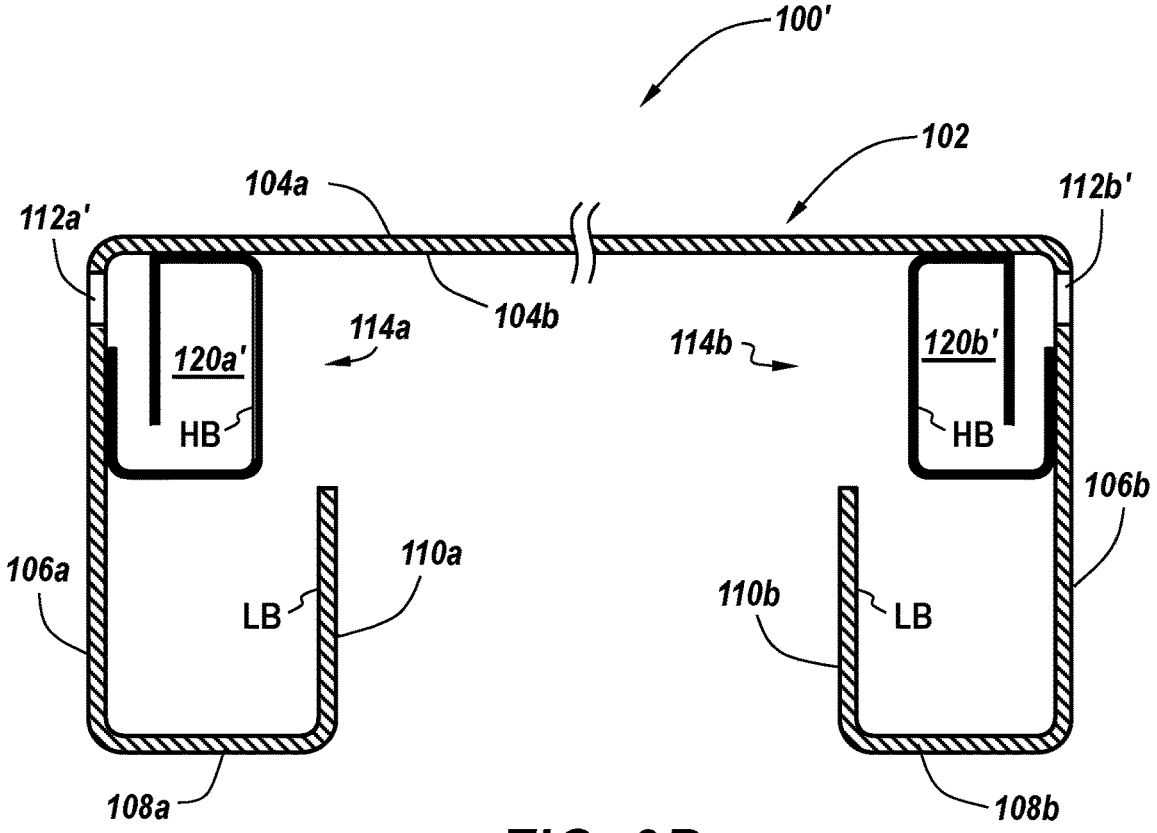
FIG. 3B is a cross-sectional view of the reflector of FIG. 3A taken along line 3B-3B.
Figure 3C:
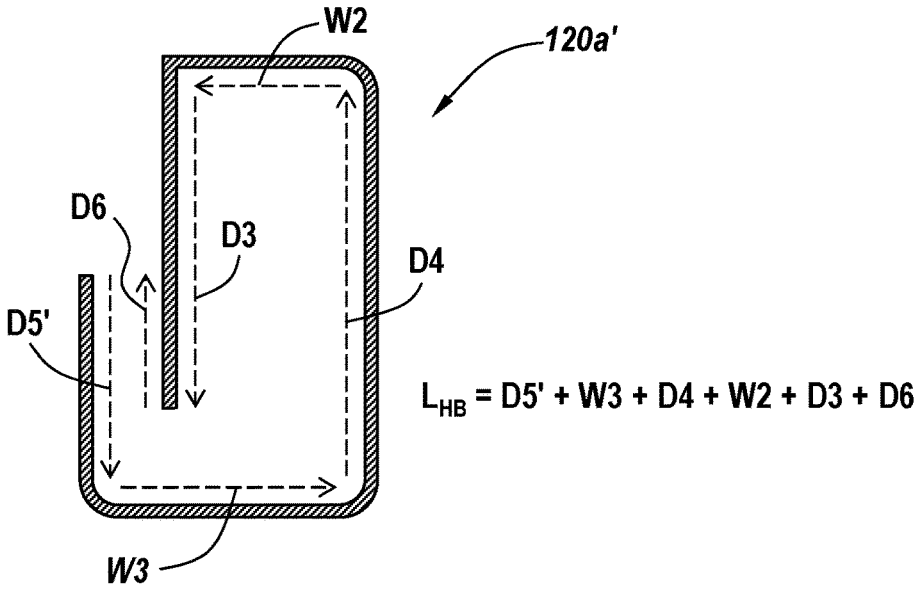
FIG. 3C is an enlarged cross-sectional view of the left side higher band (HB) choke of FIG. 3B.

Referring now to FIGS. 3A-3C, an alternative reflector 100' may be provided with somewhat enhanced structural integrity relative to the reflector 100 of FIGS. 2A-20. In particular, as shown by FIGS. 3A-3B, the multiple elongate through-slots 112*a*, 112*b* of FIGS. 2A-2B may be moved away from the corners between the main reflector surface 102 and the reflector sidewalls 106*a*, 106*b*, to locations in the sidewalls 106*a*, 106*b* that are spaced from the structurally supportive corners. As shown by FIGS. 3B-3C, these modified slots 112*a*', 112*b*' result in a concomitant change in the locations of the openings and the dimensions of the HB chokes 120*a*', 120*b*', whereby each HB choke 120*a*', 120*b*' has a somewhat modified length $L_{HB}$=D5'+W3+D4+W2+D3+D6, where D5'<D5 (in FIG. 2C) and D6<D3.

Figure 3D:
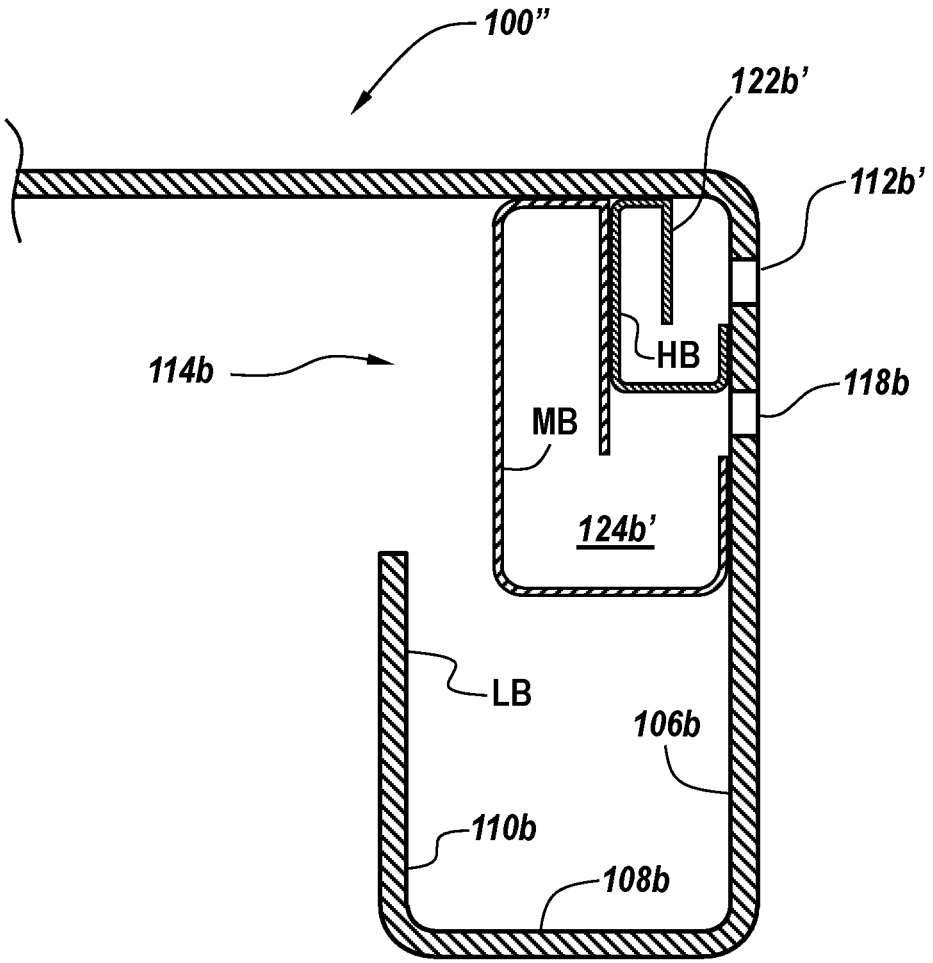
FIG. 3D is a partial cross-sectional view of the reflector of FIG. 3B as modified to include a tri-choke (e.g., choke-within-a-choke-within-a-choke) assembly, according to an embodiment of the invention.
Figure 3E:
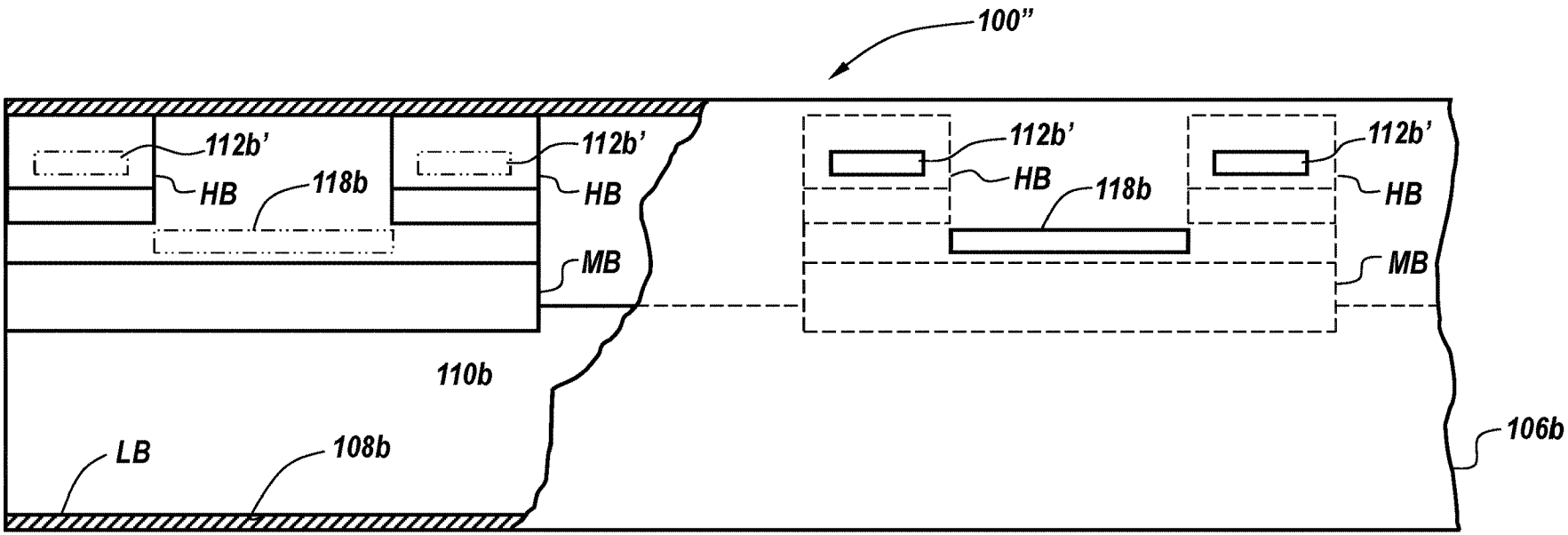
FIG. 3E is a partial side view of the reflector of FIG. 3A as modified to include the tri-choke assembly of FIG. 3D.

In addition, as illustrated by the partial cross-sectional view of FIG. 3D and the reflector side view of FIG. 3E, a modified tri-choke assembly may be provided adjacent each of the pair of rearwardly extending sidewalls of a reflector 100". According to this multi-choke assembly, a relatively high band (HB) choke 122*b*' is provided, which is nested within and adjacent a relatively mid-band (MB) choke 124*b*', which itself is nested within a relatively low-band (LB) choke defined by reflector segments 106*b*, 108*b* and 110*b* and choke opening 114*b*. As further shown by FIGS. 3D-3E, elongate choke openings/slots 112*b*', 118*b*, which are aligned to expose an interior of a respective one of the MB and HB chokes, are preferably distributed along the reflector sidewall 106*b* to thereby support coupling of RF energy into each of the MB and HB chokes (124*b*', 122*b*').

Figure 5A:
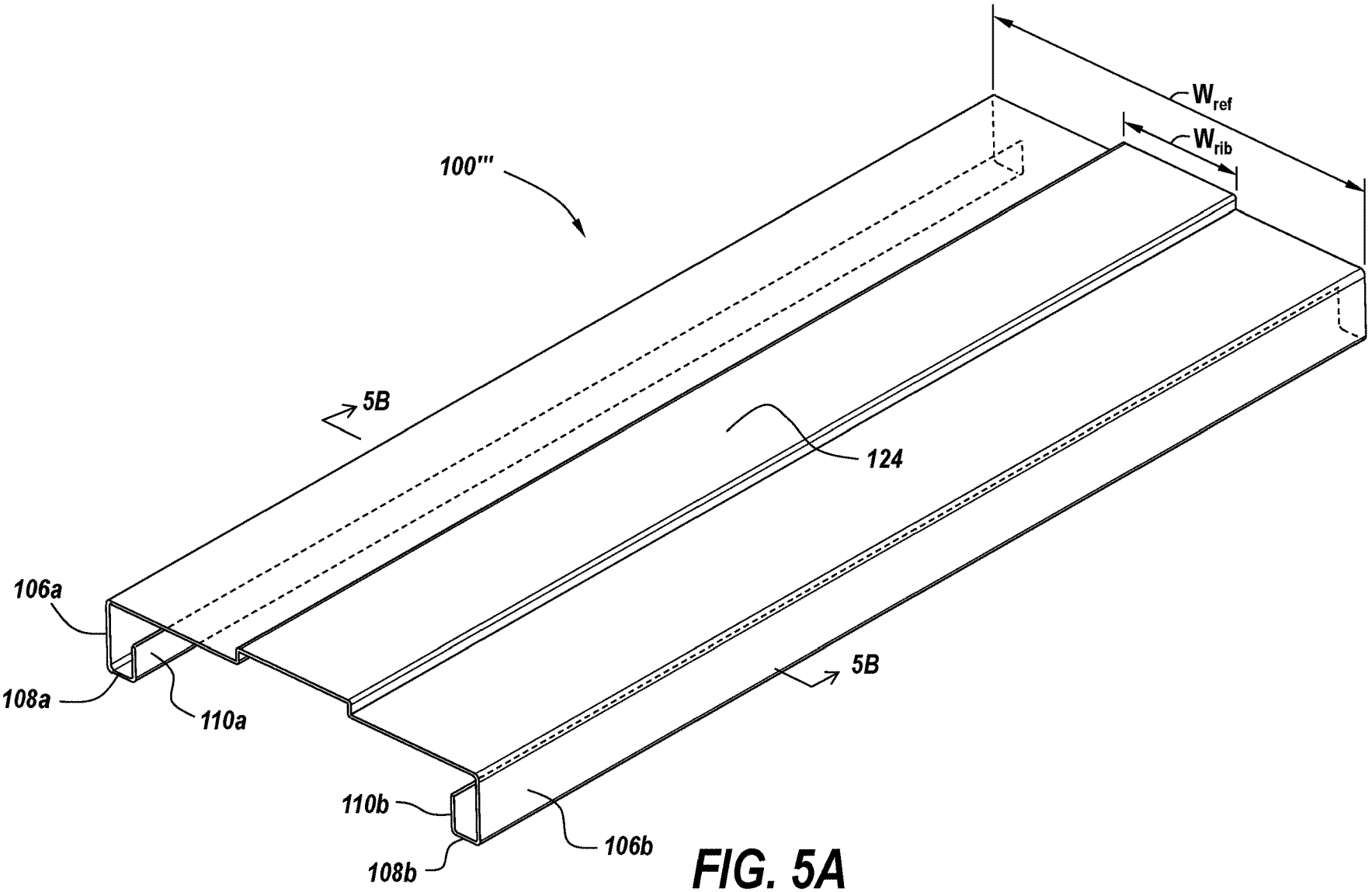
FIG. 5A is a perspective view of a base station antenna reflector having a raised and rigidity-enhancing rib and a pair of rearwardly-extending chokes, according to an embodiment of the invention.
Figure 5B:
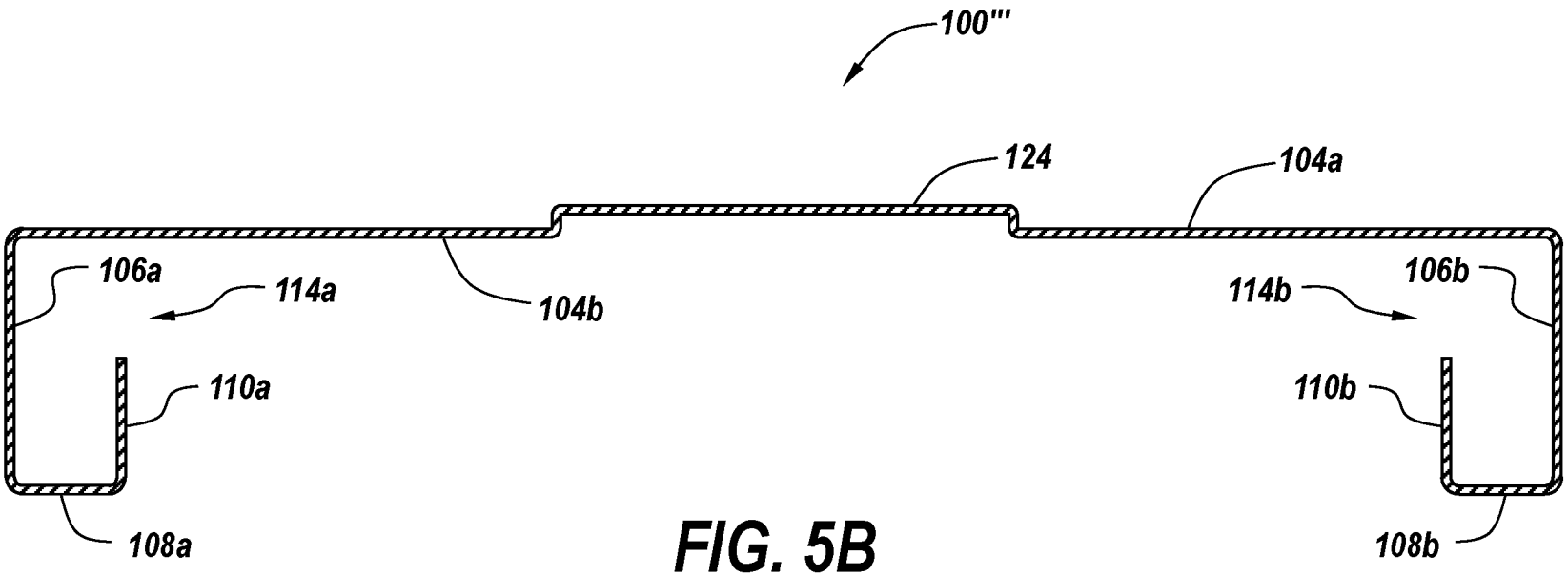
FIG. 5B is a cross-sectional view of the reflector of FIG. 5A, taken along line 5B-5B.

Furthermore, as shown by FIGS. 5A-5B, a base station antenna reflector 100''' may be provided with a raised and rigidity-enhancing rib 124 intermediate the front side 104*a* of the reflector 100''', which advantageously enables the use of thinner reflectors 100''' (e.g., 25% thinner). According to some embodiments of the invention, the rigidity-enhancing rib 124 may have a width ($W_{rib}$) in a range from about 0.2 to about 0.3 times the width ($W_{ref}$) of the reflector 100'''. For example, a rib 124 having a width of 75 mm may be provided for a reflector 100''' having a width of 287 mm and thickness of 1.2 mm (reduced from 1.6 mm).

As shown, the reflector 100''' also includes a pair of rearwardly-extending chokes, which are defined by rearwardly extending sidewalls 106*a*, 106*b*, choke bottoms 108*a*, 108*b*, and interior choke sidewalls 110*a*, 110*b* that extend opposite a rear side 104*b* of the reflector 100". The exposed ends of interior sidewalls 110*a*, 110*b* define opposing choke openings 114*a*, 114*b*, which face each other adjacent the rear side 104*b* of the reflector 100'''. These rearwardly-extending chokes may be utilized independently, as shown by FIGS. 5A-5B, or may be utilized in combination with the multi-choke assemblies illustrated in cross-section by FIGS. 2B, 3B and 3D.

Referring now to FIGS. 4A-4B, the main reflector surface 102 and the pair of LB chokes associated with the reflector 100 of FIGS. 2A-2B, may be formed from a single sheet of electrically conductive material (e.g., aluminum (Al)) having a width W, a length L, and two columns of elongate slots ($S_1$-$S_N$), as through-holes of predetermined length $L_S$. As shown by FIG. 4A, the width W is equivalent to a sum of the width W1 of the desired main reflector surface 102, and the "electrical" lengths of the left and right LB chokes (i.e., D1+W1+D2=$W_{2L}$=$W_{2R}$), and the dotted lines represent the bend/fold lines associated with manufacturing the metal sheet into a structurally rigid antenna reflector 100 for the antenna 200 of FIG. 4B. This antenna 200 is configured to support linear arrays of mid band MB radiating elements 210 (e.g., $f_{MB}$=1427-2690 MHz), relatively low band LB radiating elements 220 ($f_{LB}$=e.g., 694-960 MHz) and possibly even high-band HB radiating elements 230 (e.g., $f_{HB}$=3300-3800 MHz) on a densely populated reflector 100 having a width $W_R$.

The present invention has been described above with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, elements, and/or components, but do not preclude the presence or addition of one or more other features, elements, components, and/or groups thereof. In contrast, the term "consisting of" when used in this specification, specifies the stated features, elements, and/or components, and precludes additional features, elements and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A base station antenna, comprising:

a reflector having a first plurality of radiating elements on a main reflector surface thereof, said reflector comprising a first rearwardly projecting sidewall on a first side thereof, and a first choke-within-a-choke assembly that comprises at least a portion of the first rearwardly projecting sidewall and wraps behind the main reflector surface so that a first choke opening is provided between a rear surface of said reflector and a portion of a first choke within the first choke-within-a-choke assembly.

2. The antenna of claim 1, wherein said reflector further comprises a second rearwardly projecting sidewall on a second side thereof, and a second choke-within-a-choke assembly that comprises at least a portion of the second rearwardly projecting sidewall and wraps behind the main reflector surface so that a second choke opening is provided between the rear surface of said reflector and a portion of a first choke within the second choke-within-a-choke assembly.

3. The antenna of claim 2, wherein a width of said reflector is equivalent to a width of the main reflector surface, as measured between the first and second rearwardly projecting sidewalls; and wherein the first and second choke-within-a-choke assemblies extend entirely within a space between the first and second rearwardly projecting sidewalls.

4. The antenna of claim 1, wherein the first choke-within-a-choke assembly comprises a first relatively high-band choke within a first relatively low-band choke.

5. The antenna of claim 4, wherein the first relatively low-band choke is configured as an at least three-sided choke; and wherein the first relatively high-band choke is configured as an at least four-sided choke.

6. The antenna of claim 5, wherein the first relatively high-band choke contacts an inner surface of the first rearwardly projecting sidewall.

7. The antenna of claim 6, wherein the first relatively high-band choke contacts the rear surface of said reflector.

8. The antenna of claim 5, wherein the first relatively high-band choke is a five-sided choke; and wherein four of the five sides of the first relatively high-band choke are configured to lie along respective sides of a rectangle when viewed in transverse cross-section.

9. The antenna of claim 8, wherein the first relatively high-band choke abuts an inner surface of the first rearwardly projecting sidewall and the rear surface of said reflector.

10. The antenna of claim 5, wherein the first relatively high-band choke is a five-sided choke with three sides extending parallel to the first rearwardly projecting sidewall and two sides extending parallel to the main reflector surface.

11. The antenna of claim 10, wherein a width of the first relatively high-band choke is in a range from about 0.4 times to about 0.7 times a width of the first relatively low-band choke, when they are viewed in transverse cross-section.

12. The antenna of claim 5, wherein a width of the first relatively high-band choke is in a range from about 0.4 times to about 0.7 times a width of the first relatively low-band choke, when they are viewed in transverse cross-section.

13. The antenna of claim 4, wherein the first rearwardly projecting sidewall has a first slot therein that exposes an opening in the first relatively high-band choke.

14. The antenna of claim 4, wherein said reflector has a first slot therein that exposes an opening in the first relatively high-band choke.

15. The antenna of claim 4, wherein the first relatively low-band choke is the first choke within the first choke-within-a-choke assembly.

16. A base station antenna, comprising:

a reflector having a main reflector surface thereon, which extends between first and second rearwardly projecting sidewalls thereof; and a tri-choke assembly, comprising:

a relatively low-band choke extending adjacent and comprising a portion of the first sidewall of said reflector, said relatively low-band choke configured to wrap behind the main reflector so that a relatively low-band choke opening is provided between a rear surface of said reflector and a portion of the relatively low-band choke;

a relatively mid-band choke within at least a portion of the relatively low-band choke; and a relatively high-band choke within at least a portion of the relatively mid-band choke.

17. The base station antenna of claim 16, wherein the relatively mid-band choke extends at least partially along the first rearwardly projecting sidewall; and wherein the relatively high-band choke extends at least partially along the first rearwardly projecting sidewall and a rear surface of the reflector.

18. The base station antenna of claim 16, wherein the relatively mid-band choke extends at least partially along the first rearwardly projecting sidewall and a rear surface of the reflector; and wherein the relatively high-band choke extends at least partially along the first rearwardly projecting sidewall and the rear surface of the reflector.

19. A base station antenna, comprising:

a reflector having a non-planar main reflector surface thereon, which is defined by a raised and rigidity-enhancing rib extending at least a majority of the length of the reflector, said reflector comprising: (i) a first rearwardly projecting sidewall on a first side thereof, (ii) a first choke that comprises at least a portion of the first rearwardly projecting sidewall and wraps behind the main reflector surface so that a first choke opening is provided between a rear surface of said reflector and a portion of the first choke, and (iii) a second choke that extends within the first choke and at least partially along the first rearwardly projecting sidewall.

20. The antenna of claim 19, wherein a width of the rigidity-enhancing rib is in a range from 0.2 to 0.3 times the width of said reflector.

21. The base station antenna of claim 19, further comprising a third choke that extends within the second choke and at least partially along the first rearwardly projecting sidewall.

22. The base station antenna of claim 21, wherein the third choke is a higher band choke relative to the second choke, and the second choke is a higher band choke relative to the first choke.

* * * * *